United States Patent [19]

Haggard

[11] 4,221,264

[45] Sep. 9, 1980

[54] TUBULAR INTERIOR WIPER

[75] Inventor: Ward M. Haggard, Beaumont, Tex.

[73] Assignee: Archie K. Haggard, Houston, Tex.

[21] Appl. No.: 848,966

[22] Filed: Nov. 7, 1977

[51] Int. Cl.[2] ..... E21B 37/00

[52] U.S. Cl. ..... 166/177; 15/104.05

[58] Field of Search ..... 166/170, 172, 177, 153, 166/154, 155, 156; 15/104.05, 104.16; 417/56; 175/246-248

[56] References Cited

U.S. PATENT DOCUMENTS

| | | | |
|---|---|---|---|
| 2,575,307 | 11/1951 | Walker | 166/170 |
| 2,740,480 | 4/1956 | Cox | 166/170 |
| 3,058,525 | 10/1962 | Humphries | 166/170 X |
| 3,276,520 | 10/1966 | Arnold | 166/170 |
| 4,034,807 | 7/1977 | Prince et al. | 166/170 |

*Primary Examiner*—James A. Leppink

*Attorney, Agent, or Firm*—Fulbright & Jaworski

[57] ABSTRACT

A wiper for wiping liquids from the interior walls of various tubulars, such as drill pipe, tubing, casing or internal upset pipe is disclosed which is particularly useful in drilling and workover as the tubular member is withdrawn from a well bore. Features of the wiper include the ability to readily and easily pass through and wipe liquids from restricted passages or bores such as internal upset pipe, means for centralizing the wiper in the passages or bore for efficient wiping, pressure equalization for equalizing pressures within the wiper with outside pressures encountered within the well bore, and ease of manufacture, assembly and disassembly, so that the wiper can be manufactured easily, readily and inexpensively, and repairs and replacement of wear prone parts can be readily and inexpensively made. Other features and advantages are disclosed.

9 Claims, 3 Drawing Figures

TUBULAR INTERIOR WIPER

BACKGROUND OF THE INVENTION

There has been a need for a wiper which wipes the internal walls of tubular members free of liquids, such as drill pipe, tubing, casing, and particularly tubular members having restricted passages, such as internal upset pipe and tubing, in operations such as drilling and workover, so that liquids, such as drilling muds, oil and the like are not spilled on the floor when coming out of the bore to change drill bits or other operations requiring removal of drill pipe, tubing and the like. Spilling of such liquids on the floor is hazardous and drilling muds are quite expensive. A number of proposals have been made in the past to wipe the inside of these tubular members free of liquid; however, these have not been entirely satisfactory.

Patents which relate to various wipers for use inside of pipes and tubes include the following U.S. patents: U.S. Pat. No. 1,510,581 to Boynton; U.S. Pat. No. 1,732,277 to Owens; U.S. Pat. No. 2,257,080 to Turner; U.S. Pat. No. 2,460,481 to Ables; U.S. Pat. No. 2,740,480 to Cox; U.S. Pat. No. 3,058,525 to Humphries; U.S. Pat. No. 3,265,133 to Burch; and U.S. Pat. No. 4,007,784 to Watson, et al. Of these patents the patent to Cox discloses a pipe wiper having a plurality of bunched flexible discs above a float for wiping the inside of drill pipes as the pipes are being removed from the well.

The patent to Humphries has a plurality of arms extending out and contacting the inner wall of the pipe for holding the Humphries cleaning apparatus in a centralized position.

The remaining patents are illustrative of the state of the art.

The foregoing patent structures and proposals have a number of disadvantages. They cannot readily pass through and clean the interior of restricted openings, such as internal upset tubing or drill pipe, they are not pressure equalized so that when pressures are encountered in the well bore damage to or malfunctioning of the wiper occurs, and they are relatively expensive to manufacture and are not readily repairable, and do not include a grappling or fishing head by which the wiper can be removed readily from the tubular members, such as by a wire line and an overshot.

It would be highly advantageous to provide a wiper for wiping liquids from the interior of tubulars as they are removed from a bore hole which overcomes the disadvantages and shortcomings of prior art wipers, such as set forth above.

SUMMARY

The present invention is directed to a wiper for wiping liquids from the interior of various tubular members which overcomes the foregoing disadvantages and shortcomings. In short, the wiper includes an elongate mandrel provided with a buoyant chamber at its bottom portion effective to float the mandrel, has a flexible centralizer connected to its bottom portion adjacent the buoyant chamber arranged to permit movement of liquid past it and centralize the lower portion of the wiper in the bore, and includes first and second flexible wipers comprised of flexible discs provided with drain openings through them and which extend outwardly far enough to engage and wipe the largest bore and flexible enough to readily retract to pass through and wipe the smallest bore of the tubular member, which wipers are secured to the mandrel and axially spaced from one another a distance sufficient so that they do not bunch up and readily pass through the smallest bore of the tubular member, such as internal upset drill pipe or tubing, and which also centralize the wiper's upper portion in the bore of the tubular. The wiper floats in the liquid in the bore with the wipers above the liquid, and as the tubular member is removed from the well bore, the wipers wipe the bore of the tubular member of liquid and any of the liquid above the wiper drains through the drain holes thereby preventing an accumulation of liquid on the floor of the drilling rig or workover rig.

The wiper includes pressure equalizing means which equalizes pressure inside the mandrel and the buoyant chamber with pressure in the tubular member to prevent damage to or malfunctioning of the wiper, and includes a fishing head which is arranged to be engaged with a grapple on a wire line for ready removal of the wiper from the bore when desired.

Preferably, the wipers are secured to the mandrel by means of spacers and an extension member and a removable retaining head, and the centralizer comprises a plurality of flexible arms which removably extend through diametrically aligned openings in the mandrel so that these wear prone parts can be readily removed and replaced.

Other features are set forth throughout.

It is therefore an object of the present invention to provide a wiper for wiping liquids from the interior of a tubular member as it is removed from a bore hole which readily and easily wipes the liquids from the bores of tubular members including those having restricted passages, such as internal upset tubing and drill pipe, and which is centralized in the bore to effectively wipe the internal walls of the bore clean of liquids.

A further object of the present invention is the provision of a wiper for wiping liquids from the internal walls of a tubular member as it is removed from a bore hole in which the wiper is pressure equalized with unexpected pressures encountered in the bore.

A further object of the present invention is the provision of a wiper for wiping liquids from the internal walls of a tubular member as it is removed from a bore hole which is inexpensive to manufacture, easy to assembly and disassemble, and in which the wear prone parts, the wipers and centralizers, can be readily removed and replaced.

A further object of the present invention is the provision of a wiper for wiping liquids from the internal walls of a tubular member as it is removed from a bore hole and which includes a fishing head which can be engaged and retrieved by a grapple on a wire line for ready removal from the tubular when desired.

Other and further features, objects and advantages of the invention appear throughout.

DESCRIPTION OF THE PREFERRED EMBODIMENTS

Figure 1:
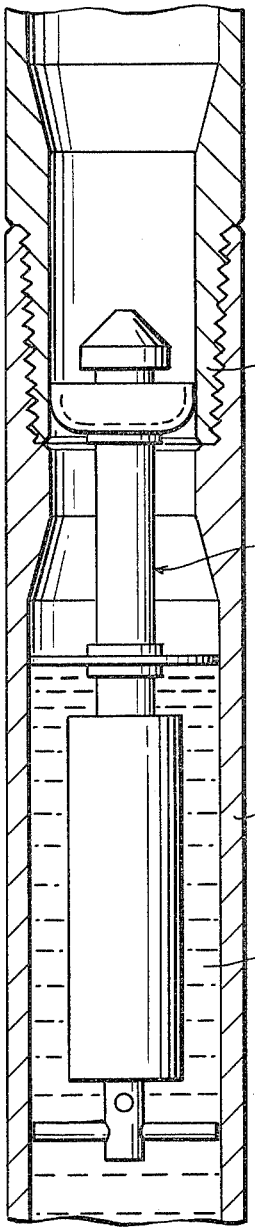
FIG. 1 is a side elevation of internal upset drill pipe or tubing illustrating a wiper in elevation according to the invention therein.

Referring now to the drawing, and particularly to FIG. 1, a tubular member 10 having the internal upset portion 12 for securing sections of the tubular members together is illustrated, which is here shown as internal upset tubing or drill pipe used in the drilling or working over of wells in a well bore or casing, not shown. While internal upset drill pipe or tubing is illustrated, the wiper of the present invention can be used for cleaning liquids from the internal walls of any tubular member, such as drill pipe, tubing, casing and various tools and apparatus having bores or passages through them. As illustrated in FIG. 1, the wiper 14 is illustrated floating in the liquid L, such as drilling mud, well liquid and the like.

In this connection, it is common practice in the drilling of bore holes for oil, gas and the like, to use various kinds and specific gravities of drilling mud which is circulated in the bore hole during the drilling operations. As previously mentioned, these muds are expensive and include chemicals, wetting materials and the like and it is highly desirable to wipe the interior walls of the tubular member clean as it is withdrawn from the bore hole or casing when coming out of the hole in drilling or workover operations. In this connection, the term "bore hole" as used herein means both cased and uncased bore holes, that is, the tubular member may be in casing in a bore hole or may be simply in an uncased bore hole.

Figure 2:
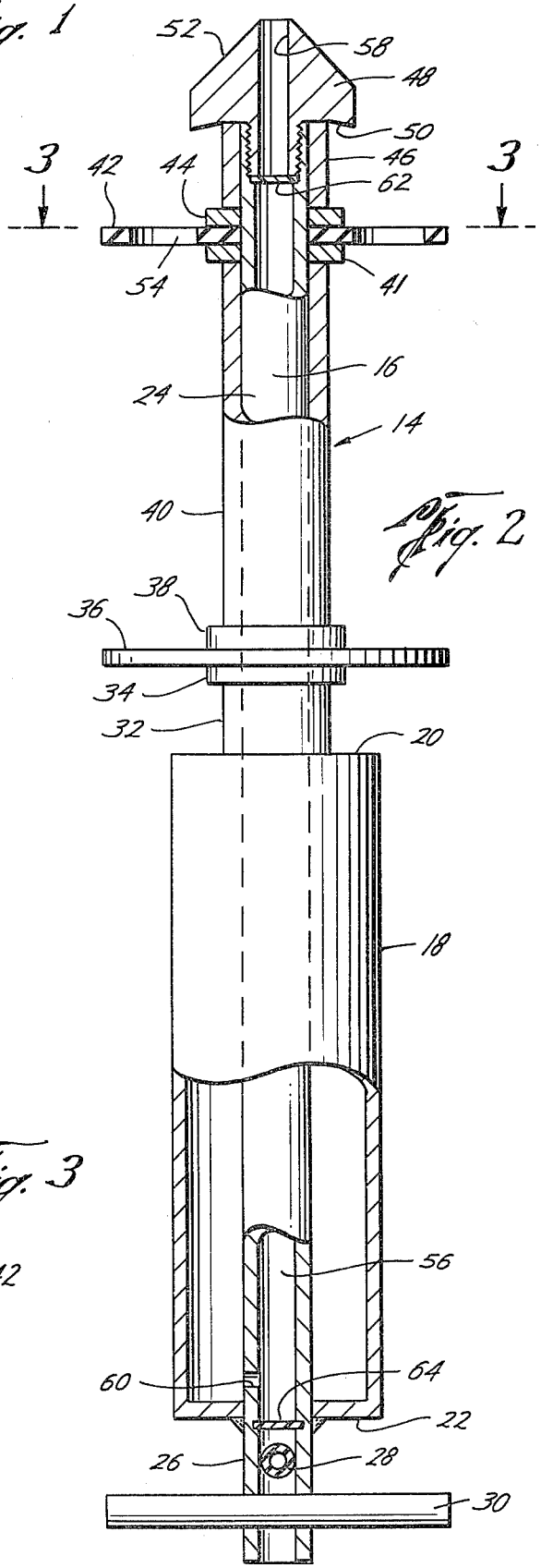
FIG. 2 is an enlarged elevational view, partly in section, illustrating the wiper of FIG. 1.

Referring now to FIG. 2, the wiper includes an elongate, tubular mandrel which preferably extends the entire length of the wiper, and has an elongate tubular buoyant chamber 18 secured about its lower portion. The chamber 18 is effective to float the wiper in liquids L in the bore of the tubular member 10 in which the wiper is to be used and is closed at its top 20 and bottom 22. The upper portion 24 of the mandrel 16 extends upwardly above the top 20 of the buoyant chamber 18 a substantial distance and the lower end 26 of the mandrel 16 extends below the bottom 22 of the buoyant chamber 18.

A flexible centralizer, here shown as a pair of flexible arms 28 and 30 which extend diametrically through the diametrically aligned openings in the bottom 26 of the mandrel 16, extends outwardly radially a distance sufficient to engage the inner walls of the bore of the tubular member 10 in which it is being used, and to centralize the lower end of the wiper 10. Preferably, these arms are rubberflex centralizers and snugly fit within the diametrically aligned openings so that they can be readily removed and replaced simply by withdrawing worn ones and replacing them with new ones.

A first tubular spacer 32 is slidably disposed on the upper portion 24 of the mandrel 16 and abuts against the top 20 of the buoyant chamber 18. Above this a washer 34 and a flexible disc-like wiping element 36 are slidably disposed on the upper portion 24 of the mandrel 16, the washer 38 being slidably provided on the topside thereof. A tubular extension member 40 is provided and is slidably disposed over the upper portion 24 of the mandrel 16, the bottom of which abuts against the upper washer 38 and the top of which abuts against the washer 41, the second flexible wiper 42 and washer 44 thereabove, all of which are slidably disposed on the upper portion 24 of the mandrel 16, the washer 38 being engaged by the upper or second tubular spacer 46. A retainer head 48 is releasably secured to the upper end of the mandrel 16, such as by the threads as illustrated and which is provided with the downwardly facing annular shoulder 50 which engages the upper end of the upper or second spacer 46 thereby maintaining and retaining the spacer 46, washer 44, flexible wiper 42, washer 41, extension member 40, washer 38, wiper 36, washer 34 and first or lower spacer 22 in position as illustrated. Advantageously, the retainer 48 has the downwardly facing annular shoulder 50 extending radially outwardly of the spacer 46 and has the tapered upper surface 52 so that it can readily be grappled by a grapple on a wire line, not shown, for removal from the bore of the tubular member 10, when desired. Since the grapple and wire line are well known and are commonly used in drilling, no detailed discussion or description thereof is deemed necessary or given.

Figure 3:
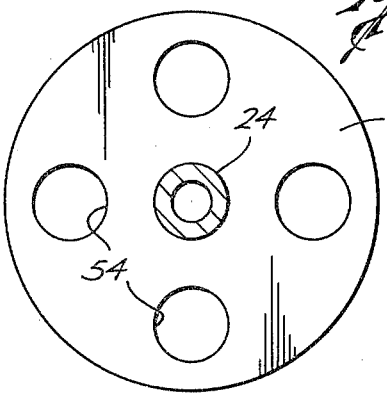
FIG. 3 is a cross-sectional view taken along the lines 3—3 of FIG. 2.

The flexible disc wipers 36 and 42 are best seen in FIG. 3, only the upper flexible disc 42 being illustrated; however, the lower flexible disc 36 is the same in structure. The flexible discs 36 and 42 are provided with the drain openings 54 to permit liquid above the flexible members to drain downwardly through them into the liquid therebelow. While any number of these drain openings may be provided, in practice, four circumferentially spaced drain openings are satisfactory.

The flexible wipers are formed of a flexible material and may be made of any suitable material, such as rubber, and are disc-shaped and extend outwardly far enough to engage and wipe the walls of the largest bore of the tubular member 10 in which it is used, yet it is flexible enough to readily retract to pass through and wipe the smallest bore thereof. In this connection, it is essential that the wipers be spaced axially a distance from one another to permit ready passage through the smallest bore, for example, the internal upset portion 12, of the tubular member 10. To provide a plurality of flexible wipers closely spaced to one another so that they bunch up would prevent the wiper from moving through the smallest or restricted bore, such as the internal upset portion 12 of the tubular member 10, when raising the tubular member out of the well bore thus bringing the wiper with it and thus not wiping the sections of the tubular member therebelow and thus not functioning as intended. Preferably, the flexible wipers are spaced a distance slightly greater than the distance of the internal upset portion so that only one of them is in the internal upset portion at a time. They may be spaced a slightly less distance, it only being necesssary that the flexible members not be so close together that in their retracted position they will cause the wiper to remain in the restricted portion as the tubular member is withdrawn from the well. Also, while two flexible wipers are illustrated, any number can be used, it only being necessary that the wipers flex sufficiently and are spaced apart enough axially so that they readily pass through restricted openings by gravity, that is, by the weight of the floating wiper. These distances are readily determined in manufacturing the wiper 14 for various end uses.

Means are provided for equalizing the pressure within the buoyant chamber 18 with the pressure in the well bore when encountering pressure to prevent damage to the buoyant chamber 18 or to collapse it, thus permitting the wiper to sink in the liquid L and not function as intended. In the embodiment illustrated, and as best shown in FIG. 2, a passage 56 is provided through the mandrel 16, and a continuing passage 58 is provided in the fishing and retaining head 48. The passage 56 in the mandrel 16 also has a passage 60 opening into the interior of the buoyant chamber 18. The passage 56 in the mandrel 16 is closed at its upper and lower ends by the rupturable discs 62 and 64. These discs will rupture under any desired difference of pressure between the exterior of the wiper 14 and the interior of the buoyant chamber 18 so that when pressure is unexpectedly encountered in use when coming out of the hole, one or both of the discs 62 and 64 will rupture thus permitting flow of pressure in the passage 56 in the mandrel 16 and through the passage 60 into the interior of the buoyant chamber 18, thereby equalizing the pressure within the buoyant chamber 18 and the mandrel 16 with the pressure in the tubular member or well bore, not shown.

In assembling the wiper, the lower end 22 of the buoyant chamber 18 is welded or otherwise secured to the lower portion 26 of the mandrel 16. The spacer 32, retainer washer 34,flexible wiper disc 36, retainer washer 38, extension member 40, retainer washer 41, flexible disc 42, retainer washer 44, and upper second spacer 46 are slid into place on the mandrel 16 and the fishing and retainer head 48 is secured to the upper end of the mandrel 16 thus securing all these parts in position. The wiper is then ready for use.

In using the wiper, and with reference to FIG. 1, the wiper floats in the liquid L, being buoyed into a floating position by the buoyant chamber 18 with the wipers 36 and 42 above the liquid L. As the tubular member 10 is withdrawn from the well the wiper 10 floats in the liquid L, gravity retaining it therein, and the flexible wiping discs 36 and 42 wipe the inner walls or bore of the tubular member 10 of liquid, such as drilling mud, oil and the like, so that when the tubular members are withdrawn to the derrick floor and disconnected these liquids do not spill on the floor. In the event pressures are encountered in the tubular member which would damage or cause malfunctioning of the wiper if not equalized, one or both of the discs 62 and 64 rupture thus equalizing pressure within the wiper 14 with outside pressure and thus preventing damage to or malfunctioning of the wiper. If for any reason it is desired to remove the wiper from the interior of the tubular member 10, a grapple on a wire line, not illustrated, can be lowered inside the passage or bore, the fishing head 48 grappled, and the wiper readily removed.

In the event it is desired to replace wear prone parts, such as the wipers 36 and 42, the fishing/retainer head 48 is removed, the worn or damaged wipers slid off and replacements slipped on the upper portion 24 of the mandrel 16 and the fishing/retainer head 48 replaced. Also, the centralizer arms 28 and 30 can be pulled out and new ones slipped in the diametrically aligned openings 28.

As previously mentioned, the distance between the flexible wipers 36 and 42 is a function of the pipe size and the tool joint or apparatus in which it is to be used. For example, for many uses, a 20 in. spacing between the wipers 36 and 42 is satisfactory. The dimensions of the bouyant chamber 18 are a function of the dimensions or internal diameter of the pipe, tool joint or apparatus in which the wiper 14 is to be used and to compensate for the weight involved and to float the wiper 14. These are all determined in advance readily and easily for a particular end use, that is, pipe or tool joint or apparatus size.

The present invention therefore is well suited and adapted to attain the objects and ends and has the advantages and features mentioned as well as other inherent therein.

While presently preferred embodiments have been given for the purposes of disclosure, changes may be made therein which are within the spirit of the invention as defined by the scope of the appended claims.

What is claimed is:

1. A wiper for wiping liquids from the interior walls of a bore of a tubular member as it is removed from a bore hole comprising, an elongate, cylindrical mandrel, an elongate, bouyant chamber closed at its bottom and top, secured about a lower portion of the mandrel, the chamber effective to float the wiper in liquids in the bore of the tubular member and being smaller in external diameter than a smallest bore of the tubular member in which the wiper is to be used, the mandrel's upper portion extending substantially above the chamber's top, a flexible centralizer carried by the wiper adjacent the bottom portion of the buoyant chamber arranged to permit movement of liquid past it, the centralizer extending outwardly sufficiently to engage a largest bore of the tubular member thereby centralizing the bottom portion of the wiper in the bore of the tubular member and flexible enough to readily pass through the smallest bore of the tubular member, first and second flexible wipers comprised of flexible discs provided with drain openings through them, the wipers extending outwardly far enough to engage and wipe the largest bore and flexible enough to readily retract to pass through and wipe the smallest bore of the tubular member, means securing the first wiper to the mandrel adjacent its top portion, means securing the second wiper to the upper portion of the mandrel above the top of the buoyant chamber, the first and second wipers being axially spaced from one another a distance sufficient to permit ready passage through the smallest bore of the tubular member and to centralize the wiper's upper portion in the bore of the tubular member, whereby the wiper floats in the liquid in the bore with the wipers above the liquid, and as the tubular member is removed from the well bore, the wipers wipe the bore of the tubular member of liquid and any of the liquid above the wipers drains through the drain openings, and means for equalizing pressure within the buoyant chamber with pressure in the well bore.

2. The wiper of claim 1 where, the mandrel is hollow and has an opening into the buoyant chamber, and the means for equalizing pressure includes, at least one pressure-rupturable disc closing the mandrel adapted to rupture and equalize pressure in the mandrel and in the buoyant chamber with pressure in the well bore when the wiper is subjected to pressure therein.

3. The wiper of claim 1 including, a fishing head connected to the upper end of the mandrel having a downwardly facing shoulder extending outwardly of the mandrel for engagement with a grapple for removal of the wiper from the bore.

4. The wiper of claim 1 where, the mandrel is hollow and has an opening into the buoyant chamber, and the means for equalizing pressure includes, at lesat one pressure-rupturable disc closing the mandrel adapted to rupture and equalize pressure in the mandrel and in the buoyant chamber with pressure in the well bore when the wiper is subjected to pressure therein, and a fishing head connected to the upper end of the mandrel having a downwardly facing shoulder extending outwardly of the mandrel for engagement with a grapple for removal of the wiper from the bore.

5. The wiper of claim 1 where, the mandrel extends through the buoyant chamber, and the flexible centralizer comprises flexible arms extending outwardly radially from the mandrel below the buoyant chamber.

6. A wiper for wiping liquid from the interior walls of the bore of a tubular member as it is removed from a bore hole comprising, an elongate cylindrical mandrel, an elongate tubular buoyant member closed at its bottom and its top secured to a lower portion of the mandrel effective to float the wiper in liquid in the bore of the tubular member, the chamber being smaller in external diameter than a smallest bore of the tubular member in which the wiper is to be used, a flexible centralizer secured to the wiper adjacent a bottom portion of the buoyant chamber, the centralizer arranged to permit movement of liquid past it and extending outwardly sufficiently to engage a largest bore of the tubular member thereby centralizing the bottom portion of the mandrel and flexible enough to readily pass through the smallest bore of the tubular member, first and second flexible wipers comprised of flexible discs provided with drain openings through them, the wipers extending downwardly far enough to engage and wipe the largest bore and flexible enough to readily retract, pass through and wipe the smallest bore of the tubular member, means securing the first wiper to the mandrel adjacent its top portion, means securing the second wiper to the upper portion of the mandrel above the top of the buoyant chamber, the first and second wipers being axially spaced from one another a distance sufficient to permit ready passage through the smallest bore of the tubular and to centralize the wiper's upper portion in the bore of the tubular, whereby the wiper floats in the liquid in the bore with the wipers above the liquid, and as the tubular member is removed from the well bore, the wipers wipe the interior walls of the bore of the tubular member of liquid and any of the liquid above the wipers drains through the drain openings, and means for equalizing pressure within the buoyant chamber with pressure in the well bore.

7. The wiper of claim 6 including, a fishing head connected to the upper end of the mandrel having a downwardly facing shoulder extending outwardly of the mandrel for engagement with a grapple for removal of the wiper from the bore of the tubular.

8. A wiper for wiping liquid from the interior walls of the bore of a tubular member as it is removed from a bore hole comprising, an elongate, tubular mandrel, an elongate, tubular buoyant chamber closed at its bottom and top, secured about a lower portion of the mandrel, the chamber effective to float the wiper in liquids in the bore of the tubular member and being smaller in external diameter than a smallest bore of the tubular member in which the wiper is to be used, the mandrel's bottom portion extending below the chamber's bottom and the mandrel's upper portion extending substantially above the chamber's top, a flexible centralizer carried by the bottom portion of the mandrel arranged to permit movement of liquid past it, the centralizer extending outwardly sufficiently to engage a largest bore of the tubular member thereby centralizing the bottom of the wiper in the bore of the tubular member and flexible enough to readily pass through the smallest bore of the tubular member, first and second flexible wipers comprised of flexible discs provided with drain openings through them, the wipers extending outwardly far enough to engage and wipe the largest bore and flexible enough to readily retract to pass through and wipe the smallest bore of the tubular member, a first tubular spacer slidably disposed about the upper portion of the mandrel and supported by the top of the buoyant chamber, the second wiper being slidably disposed about the mandrel above the first spacer, a tubular extension member slidably disposed about the mandrel above the second wiper, the first wiper being slidably disposed about the mandrel above the extension member, a second spacer member slidably disposed about the mandrel above the first wiper, a retaining and fishing head releasably secured to the upper end of the mandrel having an outwardly extending and downwardly facing annular shoulder engaging the second spacer securing the first and second spacers and the extension member, and the first and second wipers on the mandrel, the downwardly facing shoulder extending outwardly of the second spacer a distance sufficient from engagement with a grapple for removal of the wiper from the bore of the tubular member, the extension member axially spacing the first and second wipers from one another a distance sufficient to permit ready passage through the smallest bore of the tubular member and to centralize the wiper's upper portion in the bore of the tubular member, whereby the wiper floats in the liquid in the bore with the wipers above the liquid, and as the tubular member is removed from the well bore, the first and second wipers wipe the bore of the tubular member of liquid and any of the liquid above the wipers drains through the drain openings, and means for equalizing pressure within the buoyant chamber with pressure in the well bore.

9. The wiper of claim 8 where, the mandrel has a passage throughout its length and a passage opening into the buoyant chamber, and the means for equalizing the pressure includes, pressure-rupturable discs closing each end of the mandrel adapted to rupture and equalize pressure in the mandrel and in the buoyant chamber with pressure in the well bore when the wiper is subjected to pressure therein.

* * * * *